US008974046B2

(12) United States Patent
Ooishi et al.

(10) Patent No.: US 8,974,046 B2
(45) Date of Patent: Mar. 10, 2015

(54) LIQUID CIRCULATION UNIT, LIQUID CIRCULATION APPARATUS AND METHOD OF MANUFACTURING COATED BODY

(75) Inventors: Yasushi Ooishi, Kanagawa-ken (JP); Haruhiko Ishihara, Kanagawa-ken (JP); Kenichi Ooshiro, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 856 days.

(21) Appl. No.: 12/721,024

(22) Filed: Mar. 10, 2010

(65) Prior Publication Data

US 2010/0247769 A1 Sep. 30, 2010

(30) Foreign Application Priority Data

Mar. 25, 2009 (JP) ..... 2009-073184

(51) Int. Cl.
*B41J 2/18* (2006.01)
*B41J 2/175* (2006.01)

(52) U.S. Cl.
CPC ..... *B41J 2/175* (2013.01); *B41J 2/17513* (2013.01); *B41J 2/1752* (2013.01); *B41J 2/17553* (2013.01); *B41J 2/17563* (2013.01); *B41J 2/17566* (2013.01); *B41J 2/17596* (2013.01); *B41J 2/18* (2013.01)
USPC ..... 347/89; 347/85; 347/7; 347/92; 347/93

(58) Field of Classification Search
CPC ..... B41J 2/17; B41J 2/175; B41J 2/1752
See application file for complete search history.

(56) References Cited

U.S. PATENT DOCUMENTS 3,930,258 A * 12/1975 Dick et al. ..... 347/7
4,153,902 A * 5/1979 Kanayama ..... 347/92
4,320,407 A * 3/1982 Goldis et al. ..... 347/92
4,680,696 A * 7/1987 Ebinuma et al. ..... 347/85
4,750,005 A * 6/1988 Piatt et al. ..... 347/89
4,825,228 A * 4/1989 Gloeckler et al. ..... 347/7

(Continued)

FOREIGN PATENT DOCUMENTS

JP 10-52923 2/1998
JP 2001-219580 8/2001

(Continued)

OTHER PUBLICATIONS

Office Action issued Feb. 1, 2011 in Japan Application No. 2009-073184 (With English Translation).

*Primary Examiner* — Laura Martin
*Assistant Examiner* — Leonard S Liang
(74) *Attorney, Agent, or Firm* — Oblon, Spivak, McClelland, Maier & Neustadt, L.L.P.

(57) ABSTRACT

A liquid circulation unit adapted to be provided in a liquid circulation apparatus to circulate a liquid, including, a first liquid storage unit to store the liquid, a sensor to detect a fluid level of the liquid stored in the first liquid storage unit, a liquid sending pump to send the liquid to an outside from the first liquid storage unit based on a detection result of the sensor, a pipe arrangement for deaeration to remove a dissolved gas in the liquid sent from the liquid sending pump, a filter to remove an impurity in the liquid sent from the liquid sending pump, a diaphragm valve which opens when the liquid is sent to the outside from the first liquid storage unit, and a cock valve which opens when the liquid is sent to the first liquid storage unit from the outside, wherein the liquid circulation unit is adapted to be provided so as to be detachable to or from the liquid circulation apparatus.

8 Claims, 7 Drawing Sheets

(56) References Cited

U.S. PATENT DOCUMENTS

| | | | | |
|---|---|---|---|---|
| 4,847,639 | A * | 7/1989 | Sugata et al. | 347/62 |
| 4,929,963 | A * | 5/1990 | Balazar | 347/89 |
| 5,863,842 | A * | 1/1999 | Ohmi | 438/758 |
| 6,179,406 | B1 * | 1/2001 | Ito et al. | 347/35 |
| 6,217,164 | B1 * | 4/2001 | Hino | 347/85 |
| 6,352,324 | B1 * | 3/2002 | Pagnon et al. | 347/6 |
| 6,517,189 | B2 * | 2/2003 | Ogawa et al. | 347/35 |
| 6,609,780 | B2 * | 8/2003 | Sugiyama | 347/33 |
| 6,702,433 | B2 * | 3/2004 | Kono | 347/85 |
| 7,594,717 | B2 * | 9/2009 | Sheinman | 347/89 |
| 7,597,434 | B2 * | 10/2009 | Nitta et al. | 347/89 |
| 7,845,784 | B2 * | 12/2010 | Nitta et al. | 347/89 |
| 7,874,656 | B2 * | 1/2011 | Ota et al. | 347/85 |
| 7,980,683 | B2 * | 7/2011 | Bansyo | 347/85 |
| 8,038,267 | B2 * | 10/2011 | Kinase et al. | 347/85 |
| 8,132,902 | B2 * | 3/2012 | Shibata et al. | 347/89 |
| 8,141,973 | B2 * | 3/2012 | Hamazaki et al. | 347/11 |
| 8,197,046 | B2 * | 6/2012 | Asami | 347/89 |
| 8,210,666 | B2 * | 7/2012 | Hirashima | 347/85 |
| 2003/0011664 | A1 * | 1/2003 | Barinaga et al. | 347/85 |
| 2003/0142177 | A1 * | 7/2003 | Suenaga et al. | 347/85 |
| 2003/0160846 | A1 * | 8/2003 | Yoshida et al. | 347/85 |
| 2004/0261705 | A1 * | 12/2004 | Kang et al. | 118/715 |
| 2005/0157130 | A1 * | 7/2005 | Inoue | 347/92 |
| 2006/0092212 | A1 * | 5/2006 | Kawamoto et al. | 347/22 |
| 2006/0114298 | A1 * | 6/2006 | Anderson et al. | 347/85 |
| 2006/0139419 | A1 * | 6/2006 | Shigemura | 347/85 |
| 2009/0040249 | A1 * | 2/2009 | Wouters et al. | 347/7 |
| 2009/0267976 | A1 * | 10/2009 | Lee et al. | 347/6 |
| 2010/0079562 | A1 * | 4/2010 | Katada et al. | 347/85 |
| 2010/0177148 | A1 * | 7/2010 | Asami | 347/85 |
| 2010/0201759 | A1 * | 8/2010 | Kawase et al. | 347/85 |
| 2010/0245495 | A1 * | 9/2010 | Katada et al. | 347/85 |
| 2011/0128329 | A1 * | 6/2011 | Yoshino et al. | 347/85 |

FOREIGN PATENT DOCUMENTS

| | | |
|---|---|---|
| JP | 2005-125667 | 5/2005 |
| JP | 2005-225192 | 8/2005 |
| JP | 2005-306005 | 11/2005 |
| JP | 2007-229609 | 9/2007 |
| JP | 2008-178820 | 8/2008 |
| JP | 2008-264767 | 11/2008 |
| JP | 2008-296112 | 12/2008 |
| JP | 2009-12188 | 1/2009 |
| JP | 2009-132019 | 6/2009 |

* cited by examiner

PRIOR ART Fig. 7

LIQUID CIRCULATION UNIT, LIQUID CIRCULATION APPARATUS AND METHOD OF MANUFACTURING COATED BODY

CROSS-REFERENCE TO RELATED APPLICATIONS

This application is based upon and claims the benefit of priority from the prior Japanese Patent Application No. 2009-73184, filed on Mar. 25, 2009; the entire contents of which are incorporated herein by reference.

BACKGROUND OF THE INVENTION

1. Field of the Invention

The present invention relates to a liquid circulation unit which is used for a liquid jet coating apparatus to jet and coat a droplet to an object to be coated, a liquid circulation apparatus and a method of manufacturing a coated body.

2. Description of the Background

A droplet jet coating apparatus is used for printing an image information, and in addition, for manufacturing various flat type display devices such as a liquid crystal display device, an organic EL (Electro Luminescence) display device, and an electron emission display device, a plasma display device, an electrophoresis display device and so on. The droplet jet coating apparatus is provided with a droplet jet head (an ink jet head, for example) to jet a liquid such as an ink and so on from a plurality of nozzles as droplets, makes the droplets land on an object to be coated such as a substrate and so on by the droplet jet head, forms a dot row of a prescribed pattern sequentially, and manufactures various coated bodies. The ink is supplied from an ink tank to the droplet jet head via a pipe arrangement (an ink flow path). The pipe arrangement is provided with a valve and a pump and so on. The liquid pressure of the ink inside the droplet jet head is kept to a negative pressure so as to prevent the leakage of the ink and so on from the nozzle (refer to Patent Document 1, for example). In such a droplet jet coating apparatus, as the ink including a material difficult to dissolve is used, the sedimentation of the material occurs by the deterioration with age of the ink, and as a result, a jet failure caused by the sedimentation is generated. To solve the problem, a droplet jet coating apparatus is proposed to circulate an ink between a droplet jet head and an ink tank (refer to Patent Document 2, for example).

However, in the above-described droplet jet coating apparatus, as a pressure fluctuation is applied to the droplet jet head via the ink inside the pipe arrangement by driving the valve and the pump, the leakage of the ink and the suction of the air and so on occur. For the reason, the leakage of the ink and the suction of the air bubbles by the droplet jet head occur, and as a result, a jet failure such as non-jet and so on may occur. Thus, a droplet jet coating apparatus capable of suppressing the occurrence of the jet failure is also proposed (refer to Patent Document 3, for example).

FIG. 7 is a diagram for explaining each unit relating to the ink circulation in the droplet jet coating apparatus stated in Patent Document 3. As shown in FIG. 7, a droplet jet head H is provided with an internal flow path Ha through which an ink supplied from a liquid storage unit 121 passes, and jets the ink passing through the internal flow path Ha from a nozzle N as droplets. A first buffer tank 119 formed so that the ink flowing from a flow path 131*a* of a liquid supply flow path 131 drops in the first buffer tank 119 is provided in the liquid supply flow path 131 positioned closer to the liquid jet head H side than a liquid supply unit P1. In addition, a second buffer tank 120 formed so that the ink flowing from a flow path 132*a* of first and second liquid return flow paths 132, 133 drops in the second buffer tank 120 is provided in the first and second liquid return flow paths 132 and 133 positioned closer to the liquid jet head H side than liquid return units P3, P4. By this, the pressure fluctuations caused by driving the liquid supply unit P1 and the liquid return units P3, P4 are absorbed by each of the air layers of the first buffer tank 119 and the second buffer tank 120, so that the occurrence of the leakage of the ink and the suction of the air and so on caused by the pressure fluctuations can be suppressed. In addition, as the ink circulates through the liquid supply flow path 131, the internal flow path Ha of the droplet jet head H, the first liquid return flow path 132 and the second liquid return flow path 133, the sedimentation of the material included in the ink can be suppressed. For these reasons, the jet failure caused by the sedimentation of the materials in the ink can be suppressed, and in addition, the jet failure caused by the exudation of the liquid or the suction of the air bubbles can be suppressed.

Next, a circulation route in a conventional and general droplet jet coating apparatus will be described. As shown in FIG. 8, a conventional droplet jet coating apparatus is provided with a supply tank 1, a liquid sending pump 2, a deaeration unit 3, a filter 4, a sub-tank 5, a head 6, a return pump 7, a discharge tank 8, and a chemical solution valve 9. The sub-tank 5 shown in FIG. 8 corresponds to the first buffer tank 119 shown in FIG. 7, and the discharge tank 8 shown in FIG. 8 corresponds to the second buffer tank 120 shown in FIG. 7. Diaphragm pumps are used for the pumps in the route, and diaphragm valves are used for the valves in the route. The circulation of the ink is achieved by repeating four actions of (A1) liquid sending, (A2) discharge, (A3) return and (A4) bypass circulation. (A1) liquid sending is an action to absorb the ink stored in the supply tank 1 by the liquid sending pump 2, to make the ink pass through the filter 4 and the deaeration unit 3, and to supply the ink to the sub-tank 5. (A2) discharge is an action to pressurize the sub-tank 5 so as to send the ink with applied pressure through an IN side to an OUT side of the head 6, and thereby to discharge the ink to the discharge tank 8. As the route inside the head 6 is the same as shown in FIG. 7, the detailed description is omitted here. The discharge action can be achieved, besides the action to pressurize the sub-tank 5, by an action to absorb the ink by making the discharge tank 8 in the negative pressure by the return pump 7. (A3) return is an action to absorb the ink discharged to the discharge tank 8 by the return pump 7 and to return the ink to the supply tank 1. (A4) bypass circulation is an action to circulate the ink in the bypass route while removing the air bubbles by the deaeration unit 3, as the material included in the ink may settle out in the route when the head is detached. The deaeration unit 3 is, specifically, a pipe arrangement for the deaeration to remove the dissolved gas in the ink using hollow fiber films. The circulation flow rate is not more than 10 ml/min so as to keep the deaeration ability.

Patent Document 1: Japanese Patent Disclosure (Kokai) P2006-192638

Patent Document 2: Japanese Patent Disclosure (Kokai) P2004-230652

Patent Document 3: Japanese Patent Disclosure (Kokai) P2008-264767

However, in the droplet jet coating apparatus stated in the above-described Patent Document 3, there is a problem described below.

Firstly, there is a problem that the pipe arrangement route is complicated. For the reason, in case of the ink exchanging operation, it was necessary to stop the apparatus for a long time so as to clean the pipe arrangement and to exchange the ink. In addition, the ink exchanging operation itself was very high in operation difficulty level, as it was necessary for an operator to enter into the apparatus. In addition, as it is necessary to withdraw the ink existing in the pipe arrangement route as waste liquid, so that the losses of the ink and the cleaning liquid were high.

In addition, there is a problem that in the discharge action, while the ink in the head is sent with applied pressure by pressurizing the first buffer tank, the ink may be discharged from the nozzle side, too. (By applying the pressure of 20 kPa in 6 seconds, the ink is discharged by about 3 cc.) As the discharge actions are performed at a frequency of once two hours, the loss amount per day becomes very large such as 3×12=36 cc, and thus much running cost is required.

In addition, there is a problem that in the circulation action when the first buffer tank is pressurized, as the head can not coat during the circulation action, the head is to be evacuated to the evacuation position. In this case, the circulation action (10 minutes are required for one cycle of liquid sending→discharge→return→bypass circulation) is required for 10 minutes per 2 hours to suppress the sedimentation of the ink, and thus the operating time of (10×12=) 120 (=10×12) minutes per a day is lost. In addition, as the line balance between the former process and the later process can not be held, (the substrate inputted from the former process can not be treated and thus becomes a backlog) the time operation availability of the line may deteriorate.

SUMMARY OF THE INVENTION

Accordingly, an object of the present invention is to provide a liquid circulation unit, a liquid circulation apparatus and a method of manufacturing a coated body which can exchange an ink easily, can reduce the ink used amount and can improve the operation availability.

According to an aspect of the present invention, there is provided a liquid circulation unit adapted to be provided in a liquid circulation apparatus to circulate a liquid including, a first liquid storage unit to store the liquid, a sensor to detect a fluid level of the liquid stored in the first liquid storage unit, a liquid sending pump to send the liquid to an outside from the first liquid storage unit based on a detection result of the sensor, a pipe arrangement for deaeration to remove a dissolved gas in the liquid sent from the liquid sending pump, a filter to remove an impurity in the liquid sent from the liquid sending pump, a diaphragm valve which opens when the liquid is sent to the outside from the first liquid storage unit, and a cock valve which opens when the liquid is sent to the first liquid storage unit from the outside, wherein the liquid circulation unit is adapted to be provided so as to be detachable to or from the liquid circulation apparatus.

According to another aspect of the present invention, there is provided a liquid circulation apparatus to circulate a liquid including, a second liquid storage unit to store the liquid, a droplet jet head to jet the liquid stored in the second liquid storage unit as a droplet, and the liquid circulation unit as described above.

According to another aspect of the present invention, there is provided a method of manufacturing a coated body to manufacture the coated body by jetting the droplet to an object to be coated by the liquid circulation apparatus described above including a jet process to jet the liquid by driving the droplet jet head, and a circulation process to circulate the liquid in the droplet jet head by suctioning in a small flow rate and a constant flow rate, wherein the liquid circulation apparatus further includes a mass flow controller to control a flow rate of the liquid circulating through a pipe arrangement route thorough which the liquid flows, and the circulation process is performed while performing the jet process.

According to the present invention, a liquid circulation unit, a liquid circulation apparatus and a method of manufacturing a coated body can be provided which can solve the conventional various problems. That is, in case of the ink changing operation, it is enough to stop the apparatus only for a time required for exchanging the detachable liquid circulation unit. In addition, it becomes possible to clean and to exchange the ink offline, and thereby the operation difficulty level can be reduced. In addition, as the pipe arrangement route is shortened, the losses of the ink and the cleaning liquid can be reduced.

In addition, as the ink does not jet under the pressurization from the nozzle side caused by the pressurization of the sub-tank, the loss of the ink is eliminated.

In addition, as the exudation and jet failure by the circulation do not occur, it is possible to jet while circulating. For the reason, the present invention has the merit that the stop time by the circulation in one time per two hours can be reduced, the operation time of the a single body of the facilities can be improved, and the line balance between the former process and the later process can be maintained.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
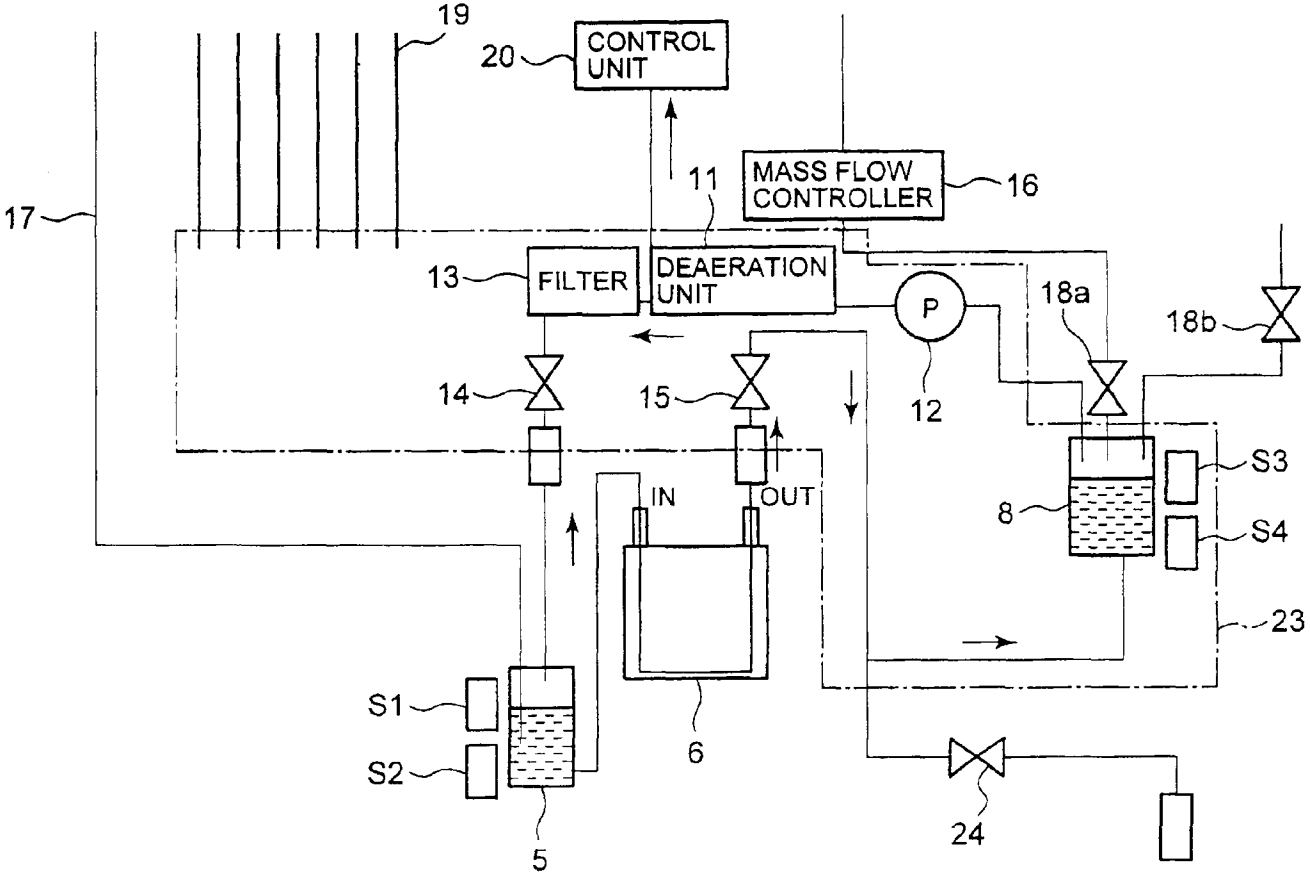
FIG. 1 is a diagram to explain a circulation route of a droplet jet coating apparatus according to an embodiment of the present invention.

Referring now to the drawings, wherein like reference numerals designate identical or corresponding parts throughout the several views, the embodiments of this invention will be described below.

A droplet jet coating apparatus (an ink jet coating apparatus and so on) according to an embodiment of the present invention is provided with a detachable liquid circulation unit 23 in which pipe arrangement routes to circulate an ink between the head 6 and the sub-tank 5 are put together, as shown in a chained line of FIG. 1. The liquid circulation unit 23 is composed as a cartridge, and is provided with a small sized discharge tank 8, a small sized deaeration unit 11, a small sized liquid sending pump 12, a filter 13, a diaphragm valve 14, and a cock valve 15. As electric equipments such as a mass flow controller 16, a gas piping 17, a suction valve 18*a*, an atmosphere open valve 18*b*, wirings 19 and a control unit 20 for the deaeration unit 11 and so on can be used regardless of the kind of the ink, so that the electric equipments are arranged outside the cartridge. Fluid level sensors S1 and S2 are sensors each of which detects the fluid level of the ink stored in the sub-tank 5 and are used during the coating action. On the other hand, fluid level sensors S3 and S4 are sensors each of which detects the fluid level of the ink stored in the discharge tank 8 and are used during the circulation action.

Figure 8:
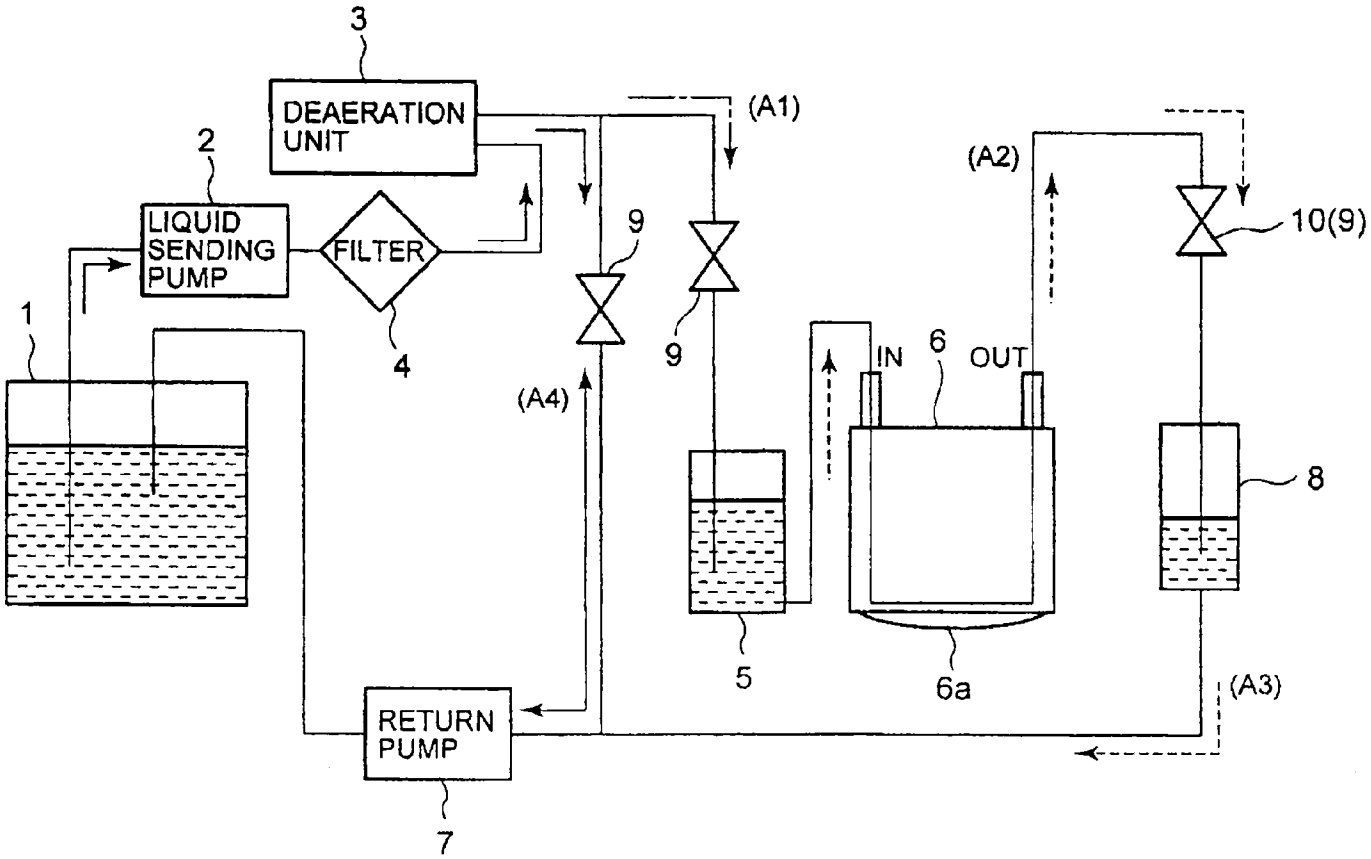
Fig. 8 Prior Art
FIG. 8 is a diagram to explain a circulation route of a conventional and general droplet jet coating apparatus.

An action of the droplet jet coating apparatus according to the embodiment of the present invention is the same as that of the conventional and general droplet jet coating apparatus shown in FIG. 8, except that the bypass circulation is omitted. Hereinafter, a feature of an action of the droplet jet coating apparatus according to the embodiment of the present invention will be described. That is, when the discharge tank 8 is filled fully with the ink, the fluid level sensor S3 is turned ON. By this, the diaphragm valve 14 is opened and the liquid sending pump 12 is driven, and the ink is returned from the discharge tank 8 to the sub-tank 5. Then when the fluid level of the ink stored in the discharge tank 8 is lowered to a prescribed position, the fluid level sensor S4 is turned ON. By this, the suction valve 18*a* and the cock valve 15 are opened, and the ink is sent from the sub-tank 5 to the discharge tank 8. Then, when the fluid level of the ink stored in the discharge tank 8 is raised to a prescribed position, the fluid level sensor S3 is turned ON. Subsequently, the above-described actions are repeated, so that the ink is circulated. In addition, the sub-tank 5 corresponds to a second liquid storage unit and the discharge tank 8 corresponds to a first liquid storage unit.

Figure 2:
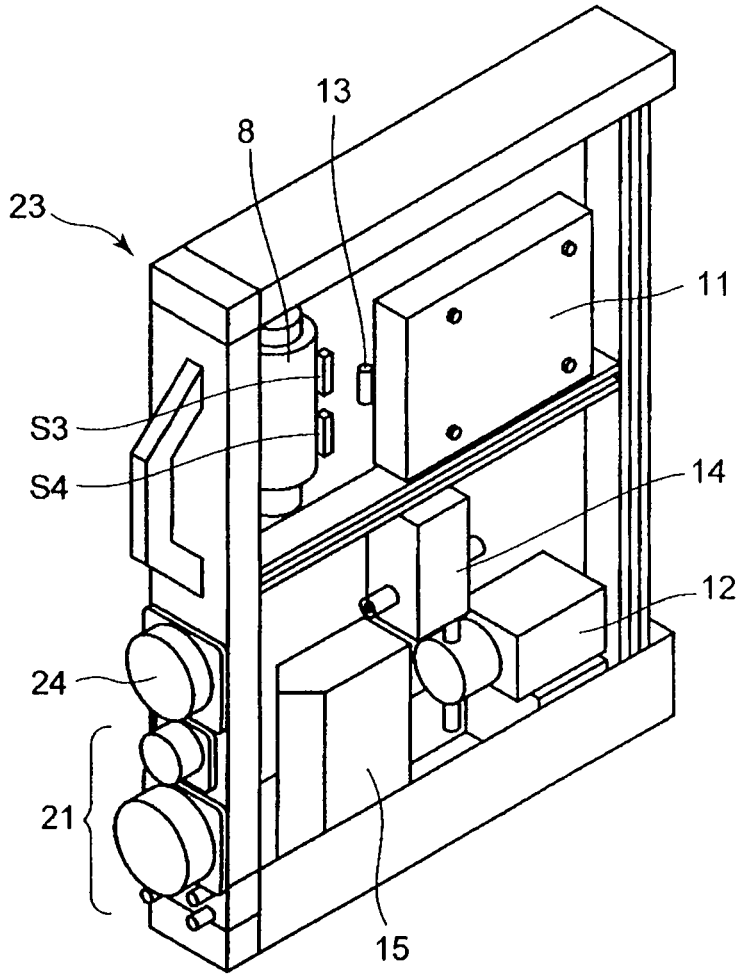
FIG. 2 is an appearance view showing a liquid circulation unit according to an embodiment of the present invention.

FIG. 2 is an appearance diagram of the liquid circulation unit 23 according to the embodiment of the present invention. The same reference numerals are used for the same components shown in FIG. 1. The size of the liquid circulation unit 23 (hereinafter referred to as a "cartridge" in some cases) is about 60 mm in width×250 mm in depth×300 mm in height, and its weight is about 3~4 kg. For the reason, an operator can convey the liquid circulation unit 23 in one hand, so that it can be easily performed to load to the apparatus or to exchange liquid circulation unit 23. The liquid circulation unit 23 and the external portion are connected with the pipe arrangement and wirings through a multi-connector and coupler 21. An input-output valve 24 is used in case of discharging an ink as waste solution or supplying an ink newly.

By the way, in the conventional droplet jet coating apparatus shown in FIG. 8, there is also a problem that a pulsation occurs during the actions of sending liquid, returning and opening and closing the valve. In case of sending the liquid in a flow rate of about 10 ml/min, a pressure fluctuation amount in the pipe arrangement usually becomes not less than 1 kPa. For the reason, it becomes impossible to keep the boundary face of the ink by the nozzle, so that a non-discharge (jet trouble) occurs in every time of the circulation. In addition, in case that the discharge valve 10 arranged at the later side of the OUT side of the head 6 out of the chemical solution valve 9 is a diaphragm valve, a volume change caused by opening and closing the valve is about 0.1 cc, so that even if the sub-tank 5 is opened to the atmosphere, a pressure fluctuation of not less than 2 kPa occurs. For the pressure fluctuation, there is a method to eliminate the boundary face itself of the ink by forming an exudation 6*a* of the ink at the nozzle face. But according to this method, as the air bubbles are already mixed in the ink discharged from the nozzle, the air bubbles also come in the nozzle by the pulsation, causing the non-discharge. In addition, in case that the exudation 6*a* of the ink is formed at the nozzle face, the circulation action during the coating action is impossible. In addition, as the coating action can not be performed during the circulation action, there was a problem that a line balance between the upstream facilities and the downstream facilities may deteriorate.

Thus, in the embodiment of the present invention, so as not to generate the non-discharge without forming the exudation 6*a*, it is aimed to minimize the pulsation in the circulation action and the valve opening and closing action. Specifically, the discharge action is realized not by the pressurization or the suction by pump, but by the suction in a small flow rate and a constant flow rate. In order to realize the suction, the mass flow controller 16 capable of controlling the flow rate is connected in the suction route, and the suction pressure is set to about −5 kPa by a negative pressure regulator. The set value differs by a water head difference of the discharge tank 8 to the nozzle face of the head 6 (a position in height of the cartridge to the head 6). In case that the height of the nozzle face and that of the fluid level of the discharge tank 8 are the same, the suction pressure is a level of −100 Pa (the pressure capable of keeping the surface tension at the boundary face of the nozzle). Actually, as it is necessary to arrange the cartridge 23 above the head 6 physically, a fluid level difference of a level of 500 mm occurs, so that and the suction pressure becomes a pressure which can compensate for the water head difference. In addition, a cock valve which is small in volume change during the opening and closing times is employed for the discharge valve 15. By employing the cock valve, the pressure difference during the valve opening and closing times can be reduced from 200 Pa up to not more than 50 Pa.

Figure 3A:
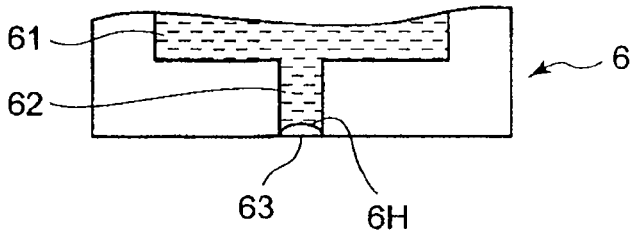
FIGS. 3A and 3B are diagrams, each of which showing a pressure fluctuation inside a head according to an embodiment of the present invention.
Figure 3B:
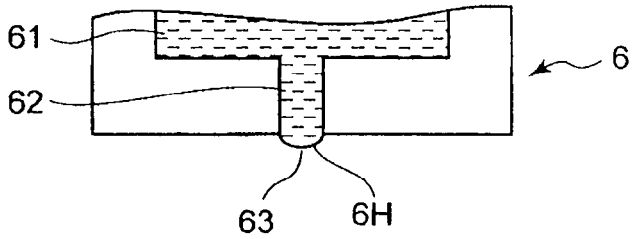
Figure 4:
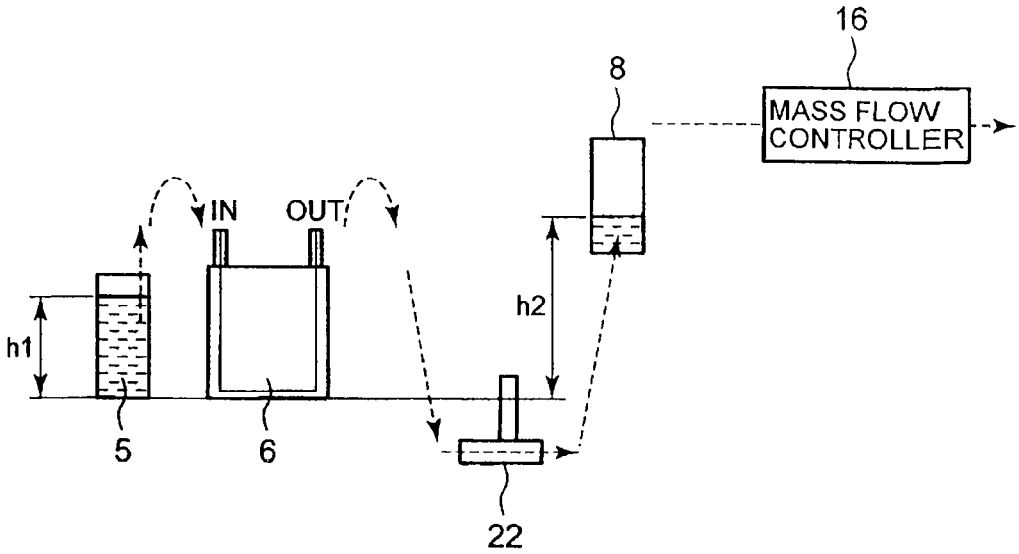
FIG. 4 is a diagram showing an arrangement of a pressure sensor according to an embodiment of the present invention.

Next, the pressure change in the ink discharge action in the head 6 will be described. As described above, the discharge action in the embodiment of the present invention is realized not by the pressurization or the suction by the pump, but by the suction in a small flow rate and a constant flow rate. In this case, as shown in FIG. 3, a fluid level 6H of an ink 61 goes up and down inside a nozzle 62. That is, the fluid level 6H of the ink 61 goes up and down between a higher position than a nozzle face 63 (refer to FIG. 3A) and a lower position then the nozzle face 63 (refer to FIG. 3B). In other words, the pressure range inside the head 6 is a range where the boundary face (meniscus) at the tip of the nozzle is not destroyed (a range where the surface tension is kept). The range is ±50 Pa, and a flow rate necessary to flow the ink 61 within the range is approximately 0.5 ml/min. According to the discharge action as described above, though it is necessary to take into consideration the property of the discharge direction, and the effect to the droplet amount, it is considered possible to realize the coating while circulating. In addition, such a pressure change is obtained by arranging a pressure sensor 22 so that the height of pressure sensor 22 is the same as that of the head 6 as shown in FIG. 4 and by measuring an analog output of the pressure sensor 22.

Figure 5:
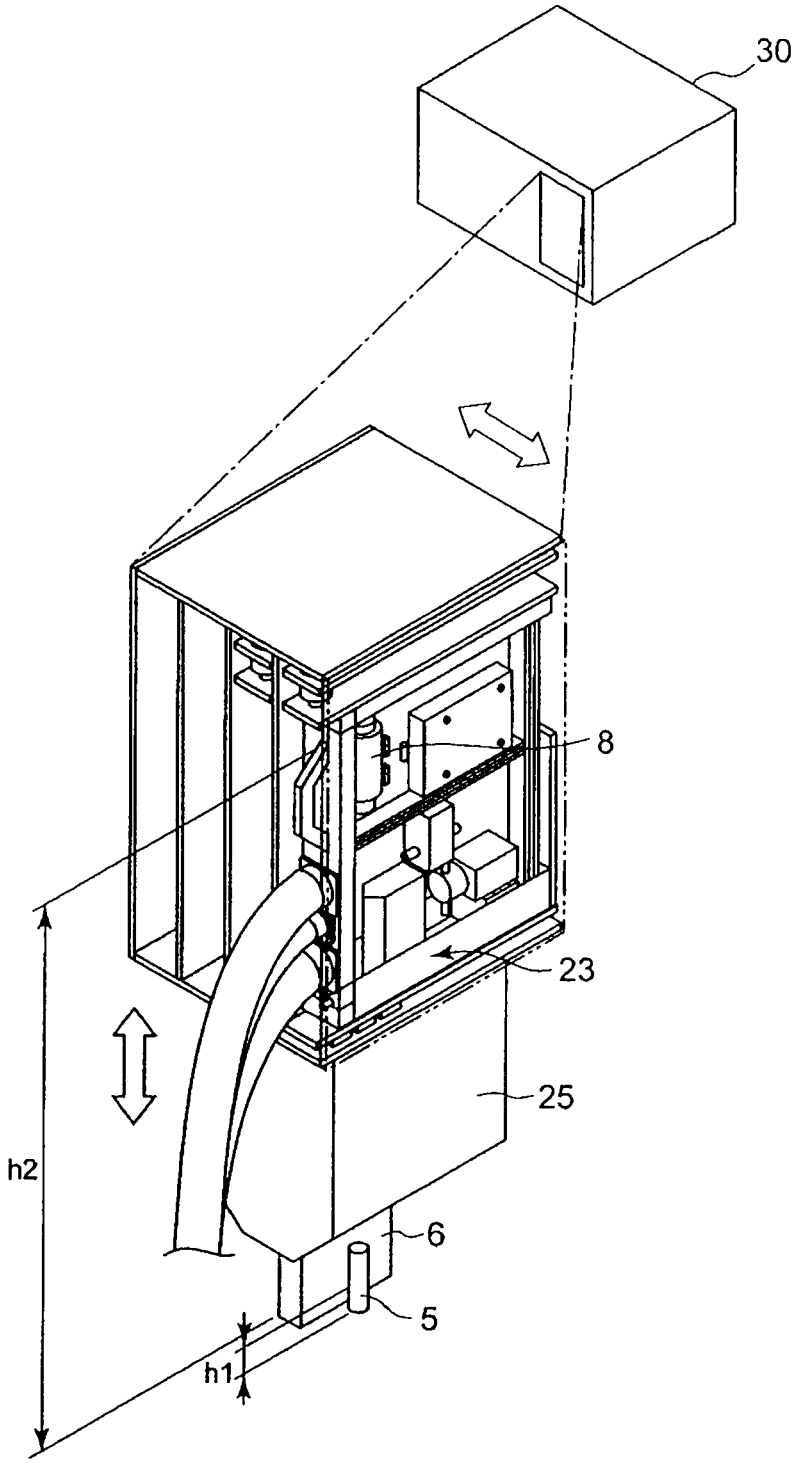
FIG. 5 is a diagram showing an arrangement of a cartridge according to an embodiment of the present invention.
Figure 6:
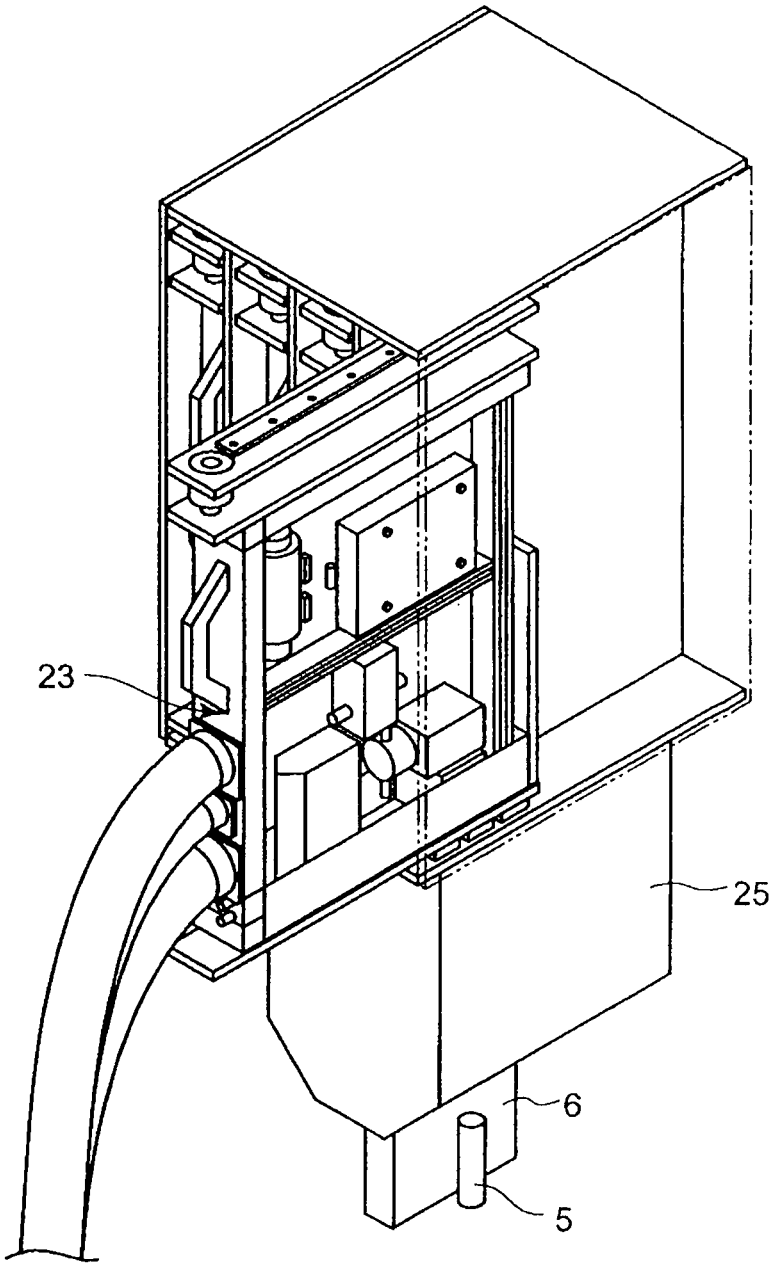
FIG. 6 is a diagram showing an arrangement of a cartridge according to an embodiment of the present invention.
Figure 7:
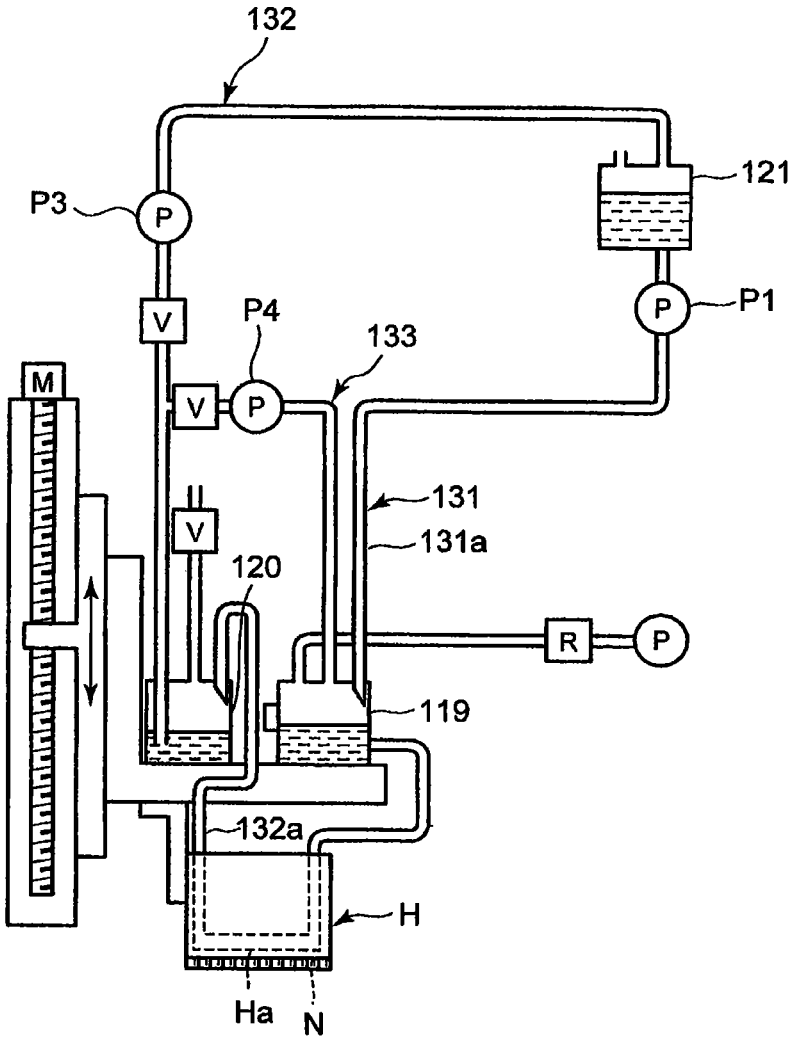
FIG. 7 is a diagram explaining each unit relating to an ink circulation in a conventional droplet jet coating apparatus.

Lastly, an arrangement of the cartridge 23 will be described. FIG. 5 shows a droplet jet coating apparatus 30 with certain parts enlarged. As shown in FIG. 5, the cartridge 23 is usually loaded above the head 6, so that the pipe arrangement between the cartridge 23 and the head 6 becomes the shortest route. During the coating action, the head 6 goes up and down, and the cartridge 23 itself is loaded on a vertical axis 25. In case of exchanging the ink, the cartridge 23 is drawn out from the slot and the cartridge 23 and the head 6 are exchanged collectively, as shown in FIG. 6. In case of carrying, the head 6 is carried in one hand, and the cartridge 23 is carried in the other hand. In case that it is wanted to circulate the ink preliminarily, after the ink is circulated offline in the cartridge 23 by itself, the cartridge 23 is loaded in the apparatus. A water head difference h2 shown in FIG. 4 is a water head difference between the nozzle face of the head 6 and the fluid level of the discharge tank 8, and becomes actually the difference h2 in height shown in FIG. 5. In addition, h1 shown in FIGS. 4 and 5 is a water head difference between the nozzle face of the head 6 and the fluid level of the sub-tank 5. In addition, in order to shorten a setup time, while various kinds of cartridges 23 (four kinds in this case) are preliminarily loaded above the head 6, a mechanism may be employed which can exchange the ink by only exchanging the head 6. As a matter of course, a construction may be employed in which heads 6 of the same number (four in this case) are preliminarily provided corresponding to the various kinds of cartridges 23, respectively.

As described above, according to the present invention, as the detachable liquid circulation unit 23 is provided in which the pipe arrangement route to circulate the ink between the head 6 and the sub-tank 5 is put together, it is enough to stop the apparatus only while the detachable liquid circulation unit 23 is being exchanged, in case of the ink exchanging action. In addition, washing and exchanging the ink can be performed offline, so that the operation difficulty level can be reduced. In addition, as the pipe arrangement route is shortened, the loss of the ink and the wash fluid can be reduced. Accordingly, the present invention can be applied effectively to the liquid circulation apparatus used in the droplet jet coating apparatus, where it is necessary to fluidize the ink easy to deteriorate or settle down, or the used ink is composed of various kinds and the ink exchanging frequency is high.

In addition, as the flow volume of the circulating ink can be suppressed as much as possible, the pulsation is reduced, the ink boundary face in the nozzle hole can be maintained. For the reason, as the occurrence of the non-discharge can be suppressed, and in addition, it can be realized that the coating action is performed while circulating, the operation availability of the apparatus can be improved. In the same manner as the conventional apparatus, the coating action may not be performed, as a matter of course, during the circulation action.

Obviously, numerous modifications and variations of the present invention are possible in light of the above teachings. It is therefore to be understood that within the scope of the appended claims, the invention may be practiced otherwise than as specifically described herein.

What is claimed is:

1. A liquid circulation apparatus to circulate a liquid, comprising:

a first liquid storage unit to store the liquid;

a sensor to detect a fluid level of the liquid stored in the first liquid storage unit;

a liquid sending pump to send the liquid to an outside from the first liquid storage unit based on a detection result of the sensor;

a pipe arrangement for deaeration to remove a dissolved gas in the liquid sent from the liquid sending pump;

a filter to remove an impurity in the liquid sent from the liquid sending pump;

a diaphragm valve which opens when the liquid is sent to the outside from the first liquid storage unit; and a cock valve which opens when the liquid is sent to the first liquid storage unit from the outside;

a second liquid storage unit to store the liquid;

a suction route which sucks air from the first liquid storage unit; and a mass flow controller physically connected to the suction route and which controls a flow rate of air to be sucked from the first liquid storage unit at a set value, wherein the liquid is circulated between the first liquid storage unit and the second liquid storage unit.

2. The liquid circulation apparatus as recited in claim 1, wherein:

the liquid circulation apparatus is a droplet jet coating apparatus to jet and coat the droplet to an object to be coated.

3. The liquid circulation apparatus as recited in claim 2, comprising a droplet jet head to jet the liquid stored in the second liquid storage unit as a droplet, wherein:

the liquid is composed of an ink, the droplet jet head is an ink jet head, and the liquid circulation apparatus is an ink jet coating apparatus.

4. The liquid circulation apparatus as recited in claim 1, further comprising a sensor to detect a fluid level of the liquid stored in the second liquid storage unit.

5. The liquid circulation apparatus as recited in claim 1, further comprising:

a droplet jet head provided between the first liquid storage unit and the second liquid storage unit and is configured to jet the liquid stored in the second liquid storage unit as a droplet, wherein the liquid circulation apparatus is a droplet jet coating apparatus.

6. The liquid circulation apparatus as recited in claim 5, wherein the droplet jet head jets the liquid as a droplet and coat the liquid to an object to be coated.

7. The liquid circulation apparatus as recited in claim 6, wherein the liquid is an ink.

8. The liquid circulation apparatus as recited in claim 1, wherein a liquid circulation unit is detachable from the liquid circulation apparatus.

* * * * *